US010758091B2

(12) United States Patent
Engell

(10) Patent No.: US 10,758,091 B2
(45) Date of Patent: Sep. 1, 2020

(54) SHOWER CADDIES WITH ADJUSTABLE BASKETS

(71) Applicant: Maytex Mills, Inc., New York, NY (US)

(72) Inventor: David H. Engell, Stamford, CT (US)

(73) Assignee: Decolin Inc., Montreal, QC (CA)

( * ) Notice: Subject to any disclaimer, the term of this patent is extended or adjusted under 35 U.S.C. 154(b) by 0 days.

(21) Appl. No.: 15/714,564

(22) Filed: Sep. 25, 2017

(65) Prior Publication Data

US 2018/0008101 A1 Jan. 11, 2018

Related U.S. Application Data

(63) Continuation of application No. 15/417,478, filed on Jan. 27, 2017, now Pat. No. 9,770,138.

(60) Provisional application No. 62/371,985, filed on Aug. 8, 2016, provisional application No. 62/288,711, filed on Jan. 29, 2016.

(51) Int. Cl.

| | |
|---|---|
| ***A47K 3/28*** | (2006.01) |
| ***A47B 55/02*** | (2006.01) |
| ***A47B 57/26*** | (2006.01) |
| ***A47K 5/04*** | (2006.01) |
| *D06F 57/12* | (2006.01) |

(52) U.S. Cl.

CPC ..... *A47K 3/281* (2013.01); *A47B 55/02* (2013.01); *A47B 57/26* (2013.01); *A47K 5/04* (2013.01); *D06F 57/12* (2013.01)

(58) Field of Classification Search

CPC ..... A47B 55/02; A47B 57/26; A47K 3/281; A47K 5/04; A47K 2201/02; A47K 3/28; D06F 57/12; A47G 29/08; A47G 29/087

USPC .... 211/119.009, 119.011, 119.004, 119, 117, 211/85.31, 106, 113, 103, 187, 190, 207, 211/107, 181.1; 223/88, 89, 94; D6/525, D6/566

See application file for complete search history.

(56) References Cited

U.S. PATENT DOCUMENTS 364,803 A * 6/1887 Christian ..... A47G 25/442 223/89

626,739 A * 6/1899 Vanderman ..... A47K 1/09 211/119.009

(Continued)

FOREIGN PATENT DOCUMENTS

GB 927624 5/1963

OTHER PUBLICATIONS

International Search Report and Written Opinion of the US International Searching Authority for PCT/US2017/015244, dated May 31, 2017 (15 pp).

(Continued)

*Primary Examiner* — Jonathan Liu
*Assistant Examiner* — Devin K Barnett
(74) *Attorney, Agent, or Firm* — Alan G. Towner; Christopher J. Owens; Leech Tishman Fuscaldo & Lampl

(57) ABSTRACT

Shower caddies with vertically and horizontally movable baskets are disclosed. Each basket is independently adjustable by a mechanism including a front plate, a rear plate and a draw fastener, which allows the user to adjust both the vertical and horizontal position of the basket from a single control point for simple and easy operation. The shower caddies may also include a tilt-resisting locking mechanism that resists rotation of the caddies when supporting an uneven load.

20 Claims, 8 Drawing Sheets

(56) References Cited

U.S. PATENT DOCUMENTS 768,446 A * 8/1904 Gager ..... A47G 25/4023 223/94
1,071,428 A 8/1913 Jones
1,184,700 A * 5/1916 McCallum ..... A47G 25/28 223/88
1,248,577 A * 12/1917 Vincent ..... A47G 25/4023 223/89
1,554,137 A 9/1925 Slifkin
1,638,844 A * 8/1927 Gibson ..... A47G 25/442 223/89
1,987,723 A 1/1935 Thomasma
2,214,118 A * 9/1940 Bracken ..... A45C 13/03 211/113
2,222,091 A 11/1940 Schray
2,335,285 A * 11/1943 Kinney ..... A47G 25/442 223/89
2,354,099 A * 7/1944 Bess ..... A47G 25/60 223/86
2,513,980 A * 7/1950 Widmann ..... A47G 25/443 223/89
2,535,625 A * 12/1950 Corwin ..... A47G 25/54 211/118
2,641,366 A * 6/1953 Burch ..... A47G 25/005 211/118
2,682,978 A * 7/1954 Brock ..... A47G 25/442 223/89
2,760,648 A * 8/1956 Van Dusen ..... A47G 25/743 211/106
D190,608 S 6/1961 Forrester
3,111,723 A 11/1963 Bates
3,131,817 A * 5/1964 Schenkler ..... A47G 25/32 223/85
3,181,702 A 5/1965 Raphael
3,641,922 A 2/1972 Nachazel et al.
3,642,241 A 2/1972 Kaufman
3,789,996 A 2/1974 Stroh
3,860,154 A * 1/1975 Atkins ..... A47G 25/32 211/113
3,923,162 A * 12/1975 Hussey ..... A47F 5/14 211/119
4,033,539 A 7/1977 Bardocz
4,467,925 A 8/1984 Ratzloff et al.
5,083,729 A 1/1992 Saeks et al.
5,085,357 A * 2/1992 Chen ..... A47G 25/4038 223/85
5,255,401 A 10/1993 Sambrookes et al.
5,613,628 A * 3/1997 Burkhalter ..... A47G 25/16 223/83
5,833,192 A 11/1998 Buhrman
5,855,184 A 1/1999 Eichler et al.
6,089,387 A 7/2000 Varfolomeeva
6,113,042 A 9/2000 Welsch et al.
6,244,479 B1 * 6/2001 Sugita ..... A47G 25/403 223/94
6,412,647 B1 7/2002 Ko
6,494,327 B2 12/2002 Huang
6,520,351 B1 2/2003 Zadro
D473,411 S 4/2003 Walker
6,581,790 B1 6/2003 Zadro
D479,073 S 9/2003 Snell
D479,074 S 9/2003 Snell
D493,991 S 8/2004 Dretzka
D494,794 S 8/2004 Winkleman
D496,549 S 9/2004 Snell
D498,102 S 11/2004 Snell
6,848,144 B1 2/2005 McDonald
6,957,794 B2 10/2005 Landreville et al.
D530,551 S 10/2006 Snell
D552,391 S 10/2007 Rosen
D562,608 S 2/2008 Kramer
D564,271 S 3/2008 Snider
D568,657 S 5/2008 Snider
D568,658 S 5/2008 Yang et al.
D572,061 S 7/2008 Snider
D572,062 S 7/2008 Snider
D572,502 S 7/2008 Yang et al.
D573,822 S 7/2008 Yang et al.
7,527,157 B2 5/2009 Shinn et al.
7,611,034 B1 11/2009 Peterson
7,731,068 B2 * 6/2010 Scicluna ..... A47G 25/32 223/88
7,770,742 B1 8/2010 Wagner et al.
D622,990 S 9/2010 Yang et al.
7,798,339 B2 9/2010 Brooks et al.
D628,000 S 11/2010 Lindo
D628,841 S 12/2010 Yang et al.
D640,488 S 6/2011 Didehvar et al.
7,959,020 B2 6/2011 Rosen
D651,837 S 1/2012 Yang et al.
8,100,305 B2 * 1/2012 Sun ..... B60R 7/10 223/85
8,186,521 B2 5/2012 Yu
8,225,946 B2 7/2012 Yang et al.
8,256,649 B2 * 9/2012 Camp ..... A47G 25/32 223/85
D676,696 S 2/2013 Primeau
8,763,821 B2 7/2014 Yang et al.
8,820,543 B2 9/2014 Huang
D714,571 S 10/2014 Walker
D718,554 S 12/2014 Snider
D723,834 S 3/2015 Tawil
D728,260 S 5/2015 Snider
D769,017 S 10/2016 Yang et al.
D769,641 S 10/2016 Tsai
D770,197 S 11/2016 Yang et al.
9,693,660 B1 7/2017 Stelmarski et al.
2003/0000905 A1 1/2003 Zidek
2004/0188369 A1 9/2004 Yu
2004/0200936 A1 10/2004 Opperthauser
2006/0261022 A1 11/2006 Sampaio
2007/0045208 A1 3/2007 Quan
2008/0000859 A1 1/2008 Yang et al.
2008/0047913 A1 2/2008 Naden et al.
2008/0053935 A1 3/2008 Newbouild et al.
2008/0164384 A1 7/2008 Rosen
2008/0224011 A1 9/2008 Chang
2008/0230494 A1 9/2008 Galt et al.
2008/0283558 A1 * 11/2008 Rude ..... A47G 25/32 223/94
2009/0188880 A1 7/2009 Yang et al.
2010/0102014 A1 4/2010 Yang
2010/0133218 A1 6/2010 Yang et al.
2011/0271438 A1 11/2011 Yang et al.
2012/0091088 A1 4/2012 Didehvar et al.
2012/0159748 A1 6/2012 Carney
2012/0217215 A1 8/2012 Emery et al.
2013/0313212 A1 11/2013 Lindo et al.
2013/0334156 A1 12/2013 Baines
2014/0124467 A1 5/2014 Kwok et al.
2014/0224754 A1 5/2014 Vaccaro et al.
2014/0124598 A1 8/2014 Baines
2014/0319083 A1 10/2014 Stark
2015/0157124 A1 6/2015 Cipolla
2015/0342419 A1 12/2015 Yatscoff
2016/0066751 A1 3/2016 Hinson
2016/0374467 A1 12/2016 Gasparino
2017/0215653 A1 8/2017 Engell

OTHER PUBLICATIONS

Title: "InterDesign Linea Adjustable Bathroom Shower Caddy for Shampoo, Conditioner, Soap—Bronze" URL: https://www.amazon.com/InterDesign-Adjustable-Bathroom-Shampoo-Conditioner/dp/B00DUVTDQS Accessed: Jun. 5, 2017 (7 pp).

International Search Report and the Written Opinion of the International Searching Authority for International Application No. PCT/US2018/052554, 13 pages.

* cited by examiner

SHOWER CADDIES WITH ADJUSTABLE BASKETS

CROSS-REFERENCE TO RELATED APPLICATIONS

This application is a continuation of U.S. patent application Ser. No. 15/417,478 filed Jan. 27, 2017, which claims the benefit of U.S. Provisional Patent Application Ser. No. 62/288,711 filed Jan. 29, 2016 and U.S. Provisional Patent Application Ser. No. 62/371,985 filed Aug. 8, 2016, which are incorporated herein by reference.

FIELD OF THE INVENTION

The present invention relates to shower caddies, and more particularly relates to shower caddies having adjustable baskets.

BACKGROUND INFORMATION

Conventional shower caddies include baskets arranged vertically on a support member extending downward from an upper hook that engages a shower pipe. The baskets are typically rigidly mounted on the support member. This arrangement often precludes the storage of larger containers of shower and bath products.

An additional disadvantage of conventional shower caddies is that they tilt due to the weight of items that are placed on or removed from the caddies. Some shower caddies use rubber grips or suction cups at their bottoms to help control the tilting, but if the objects placed in the baskets are sufficiently heavy they may still tilt.

SUMMARY OF THE INVENTION

The present invention provides shower caddies with vertically and horizontally movable baskets. Each basket is independently adjustable by a mechanism including a front plate, a rear plate and a draw fastener, which allows the user to adjust both the vertical and horizontal position of the basket from a single control point for simple and easy operation. The shower caddies may also include a tilt-resisting locking mechanism that resists rotation of the caddies when supporting an uneven load.

An aspect of the present invention is to provide a shower caddy assembly comprising a vertical support structure comprising a first and a second vertical support rod, at least one basket coupled to the vertical support structure, and an adjustment mechanism comprising a front plate having an upper distal edge, a rear plate having an upper distal edge, and a draw fastener, wherein the upper distal edge of the front plate is spaced from the upper distal edge of the rear plate when the first and second support rods are clamped between the front and rear plates.

This and other aspects of the present invention will be more apparent from the following description.

DETAILED DESCRIPTION

Figure 1:
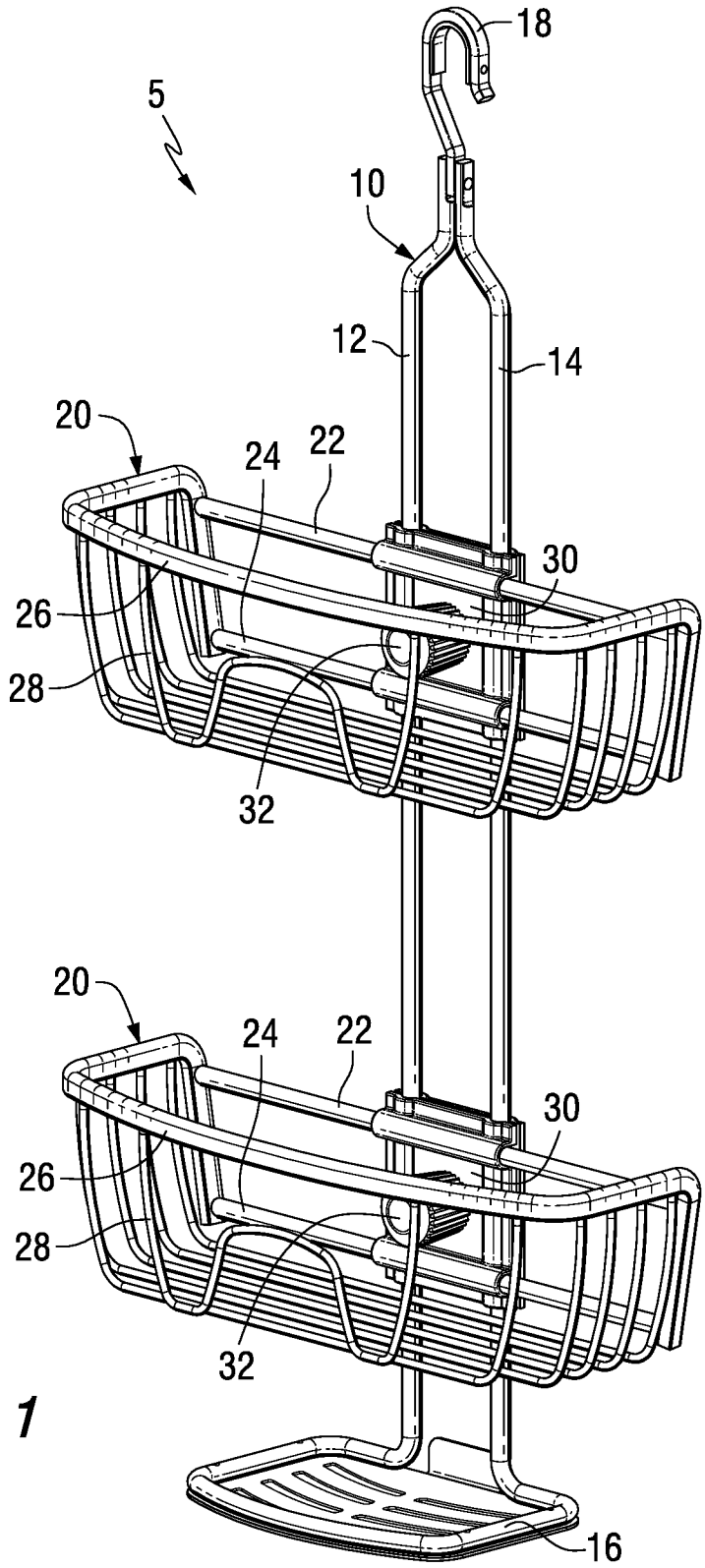
FIG. 1 is an isometric view of a shower caddy assembly including adjustment mechanisms in accordance with an embodiment of the present invention.
Figure 4:
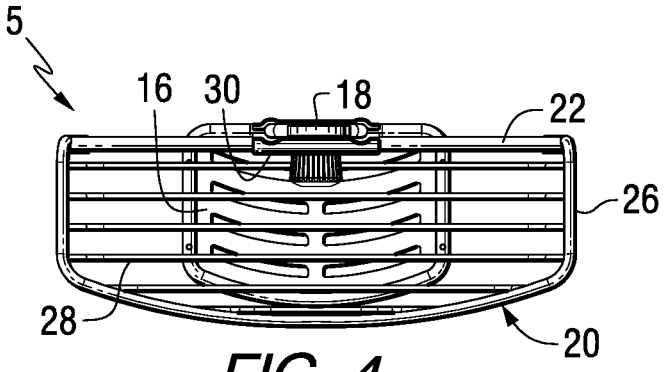
FIG. 4 is a top view of the shower caddy of FIG. 1.
Figure 2:
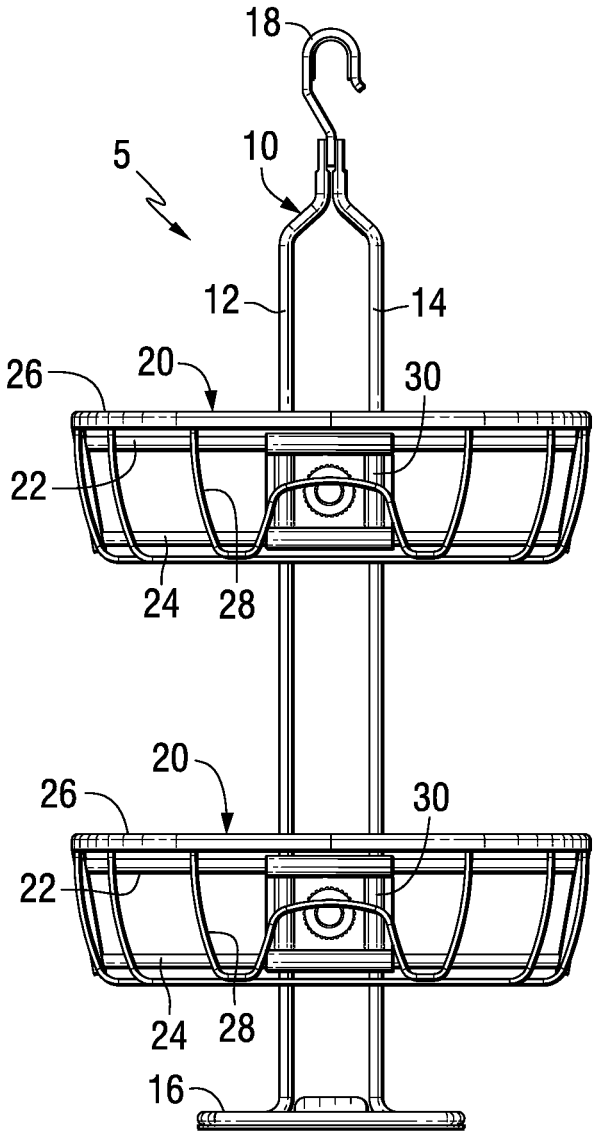
FIG. 2 is a front view of the shower caddy of FIG. 1.

FIG. 1 illustrates a shower caddy assembly 5 in accordance with an embodiment of the present invention. The shower caddy assembly 5 includes a vertical support structure 10 comprising a first vertical support rod 12, a second vertical support rod 14 parallel with the first vertical support rod 12, and a bottom shelf 16. The vertical support structure 10 may be mounted on a shower pipe connected to a shower head (not shown) by a tilt-resisting support hook 18, which is described in more detail below. In the embodiment shown, the shower caddy assembly 5 includes two baskets 20 mounted on the vertical support structure 10 by an adjustment mechanism 30. The baskets 20 are configured to hold a variety of bathing accessories. While two baskets 20 of similar size are shown in this embodiment, any other suitable number of baskets 20 may be used. For example, one, three, four or more baskets may be mounted on the vertical support structure 10. In addition, the baskets may vary in size, for example, the top basket may be smaller than the bottom basket.

As shown in FIGS. 1-4, each basket 20 includes an upper horizontal basket support rod 22, a lower horizontal basket support rod 24, a retaining rod 26 and retaining wire 28. In the embodiment shown, each basket 20 comprises two horizontal basket support rods, however, it is to be understood that any other suitable number of horizontal basket support rods may be used, e.g., one, two, three or more horizontal basket support rods. For example, a basket 20 with a single horizontal support rod at the upper edge of the basket 20 may be used. The upper and lower horizontal basket support rods 22 and 24 are located at the rear of each basket 20, are parallel with each other, and are vertically offset from each other. In the embodiment shown, the retaining rod 26 is connected to the upper and lower horizontal basket support rods 22 and 24 and forms the upper front and side portions of the basket 20. The retaining wire 28 is connected to the retaining rod 26 and forms the bottom of the basket 20. In accordance with another embodiment, the upper and/or lower horizontal basket support rods 22 and 24 may be extended along the side and front portions of the basket 20 thereby providing an integral structure in place of the retaining rod 26. In the embodiment shown, the retaining wire 28 is connected to the upper and lower horizontal basket support rods 22 and 24 to form the bottom of the basket 20 and to provide a rigid basket. While particular basket arrangements are described herein, it is to be understood that any other suitable basket structures may be used in accordance with the present invention.

In the embodiment shown, the bottom shelf 16 is formed by an extension of the first and second vertical support rods 12 and 14 which form the perimeter of the bottom shelf 16. In another embodiment, the bottom shelf 16 may be mounted on the vertical support structure 10 by an adjustment mechanism similar to the mechanism 30 used with the baskets 20. The bottom shelf 16 may be configured as a soap dish having a bottom formed by an insert placed into a central opening formed by the first and second vertical support rods. However, any other suitable arrangement of the bottom shelf 16 may be used. For example, the bottom shelf 16 may comprise a wire bottom, hooks or the like, or the bottom shelf may be eliminated.

Figure 5:
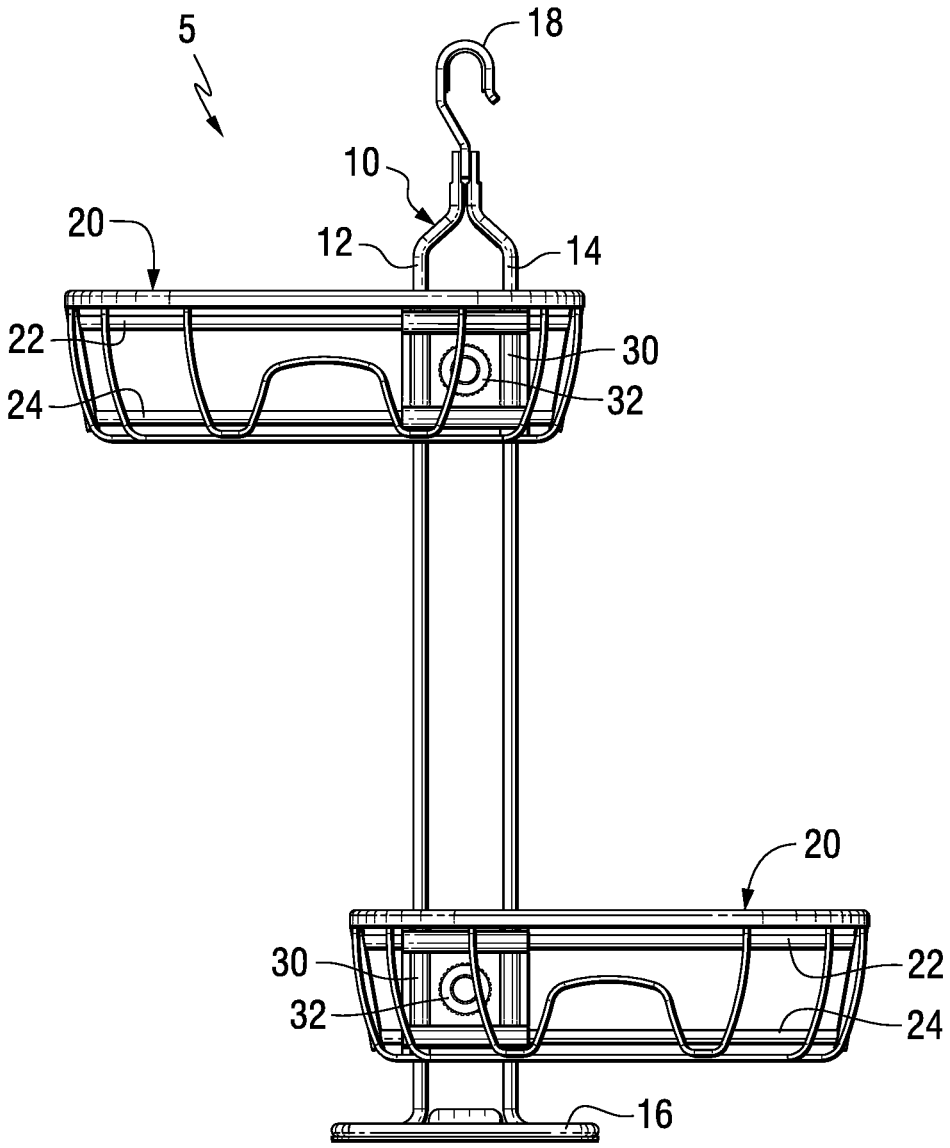
FIG. 5 is a front view of the shower caddy of FIG. 1, showing the baskets adjusted to different horizontal and vertical positions using the adjustment mechanisms in accordance with an embodiment of the present invention.

In accordance with embodiments of the present invention, the adjustment mechanism 30 includes a draw fastener 32 for selectively positioning the basket(s) 20 at desired locations. As shown by comparing FIGS. 2 and 5, each adjustment mechanism 30 of the shower caddy assembly 5 allows its respective basket 20 to be adjustably positioned at different horizontal positions, and at different vertical positions, in relation to the vertical support structure 10. When the shower caddy assembly 5 is mounted on a shower pipe (not shown), the first and second vertical support rods 12 and 14 of the vertical support structure remain stationary, while the adjustment mechanism 30 allows the baskets 20 to move both vertically up and down, and horizontally left and right. The ability of the baskets 20 to move both vertically and horizontally allows the shower caddy assembly 5 to easily accommodate containers and other bath items and accessories of varying sizes. As more fully described below, the provision of an adjustment mechanism 30 with a single draw fastener 32 allows for easy manipulation both horizontally and vertically of each basket 20 with a simple loosening and tightening of the draw fastener 32. The simple manipulation of the draw fastener 32 for each basket 20 can be performed at a single central location.

Figure 6:
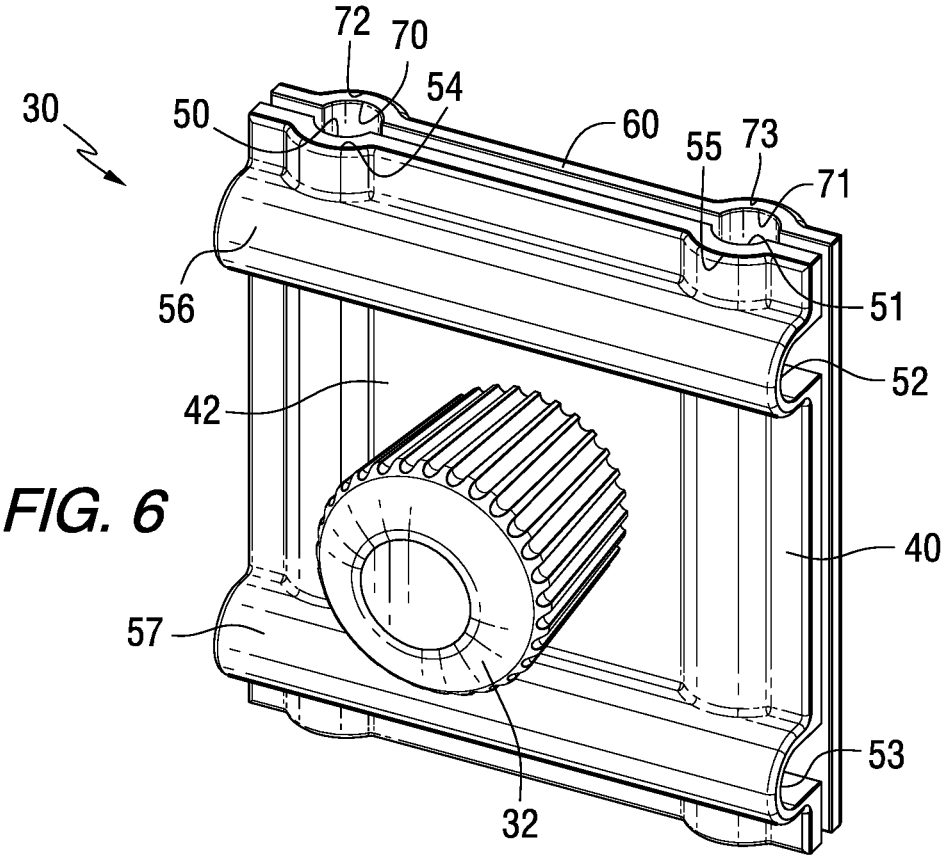
FIG. 6 is an isometric view of an adjustment mechanism in accordance with an embodiment of the present invention.
Figure 7:
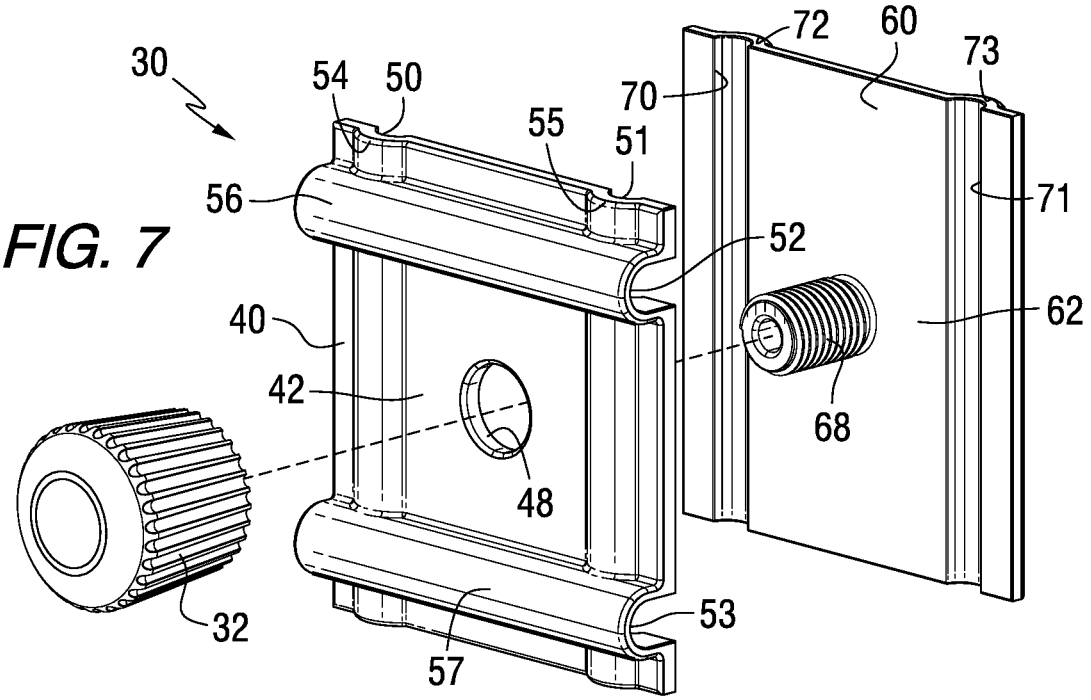
FIG. 7 is an exploded isometric view of the adjustment mechanism of FIG. 6.
Figure 8:
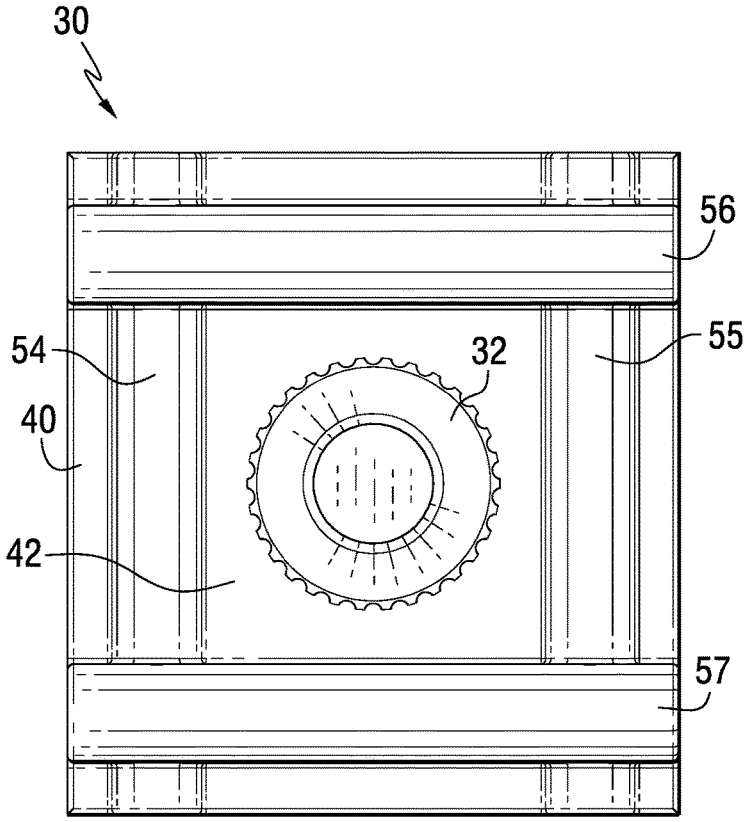
FIG. 8 is a front view of the adjustment mechanism of FIG. 6.

As shown in FIGS. 6-8, the adjustment mechanism 30 comprises a generally planar front plate 40, a generally planar back plate 60, and the draw fastener 32. When the shower caddy assembly 5 is installed, the front and back plates 40 and 60 are aligned in parallel vertical planes that are offset from each other. The front plate 40 is horizontally moveable from the back plate 60 in a direction normal to planes of the plates 40 and 60. The draw fastener 32 may be tightened to draw the front plate 40 toward the back plate 60 to secure the front and back plates against vertical movements with respect to the vertical support rods 12 and 14. The draw fastener 32 also secures each basket 20 against horizontal movement. In the embodiment shown, the draw fastener 32 comprises an internally threaded adjustment knob that may be threadingly engaged with a threaded stud 68 extending from the back plate, however, any other suitable hand manipulatable mechanism may be used. The draw fastener 32 may be rotated to increase the spacing between the plates 40 and 60 in order to allow sliding movement of the vertical support rods 12 and 14 within the adjustment mechanism 30, and to allow sliding movement of the horizontal basket support rods 22 and 24 within the adjustment mechanism 30. The draw fastener 32 of the adjustment mechanism 30 may thus provide a central control point for simple and easy operation.

The adjustment mechanisms 30 may be made of any suitable materials, including plastic, metals, or the like. For example, the front plate 30, back plate 60 and draw fastener 32 may be made of plastics such as polyethylene, polypropylene or polyvinyl chloride that are sufficiently rigid but slightly flexible to allow a desired amount of deflection when the draw fastener 32 is tightened to draw the front and back plates 40 and 60 together.

As shown in FIGS. 6-8 and 11, the front plate 40 includes a planar central region 42, left edge 43, right edge 44, top edge 45, bottom edge 46, and center opening 48. In the embodiment shown, the center opening 48 is located in the center of the planar central region 42 of the front plate. In the embodiment shown, a generally square front plate 40 having four straight edges is shown. However, any other suitable shape of front plate may be used, e.g., rectangular, circular, ovular, triangular, a shape having two straight edges and two curved edges, or the like.

Figure 10:
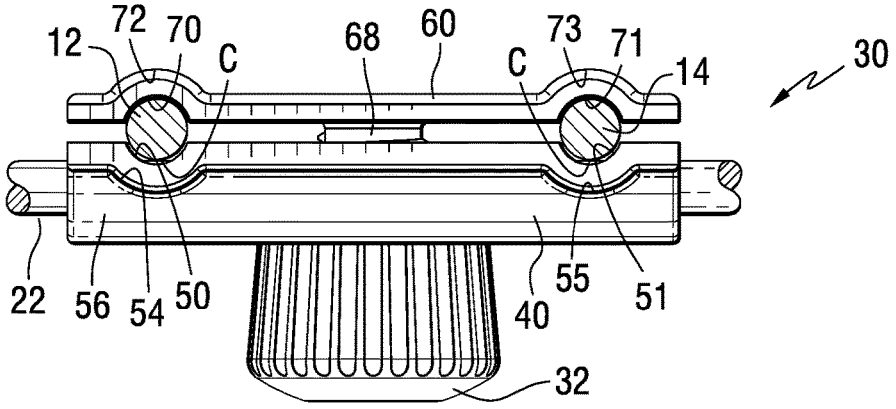
FIG. 10 is a top view of the adjustment mechanism of FIG. 6.
Figure 9:
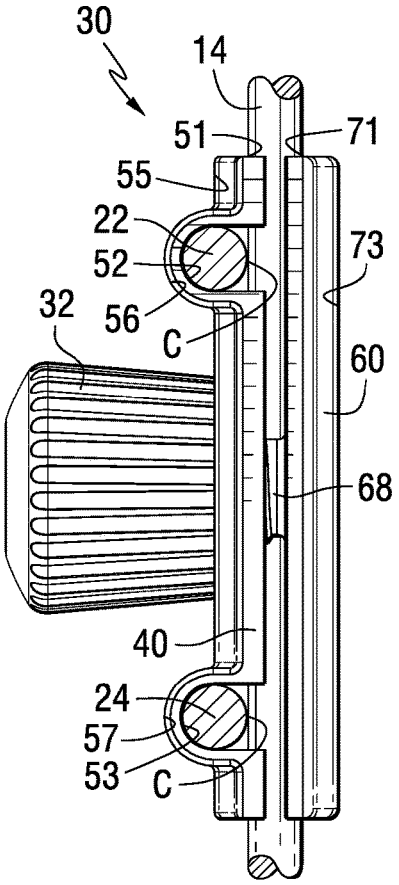
FIG. 9 is a side view of the adjustment mechanism of FIG. 6.
Figure 13:
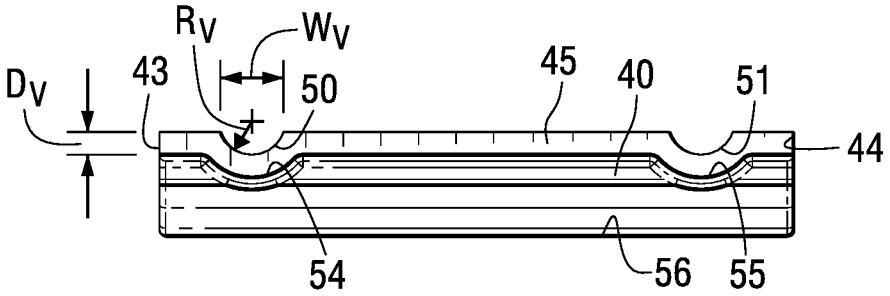
FIG. 13 is a top view of the front plate of FIG. 11.
Figure 11:
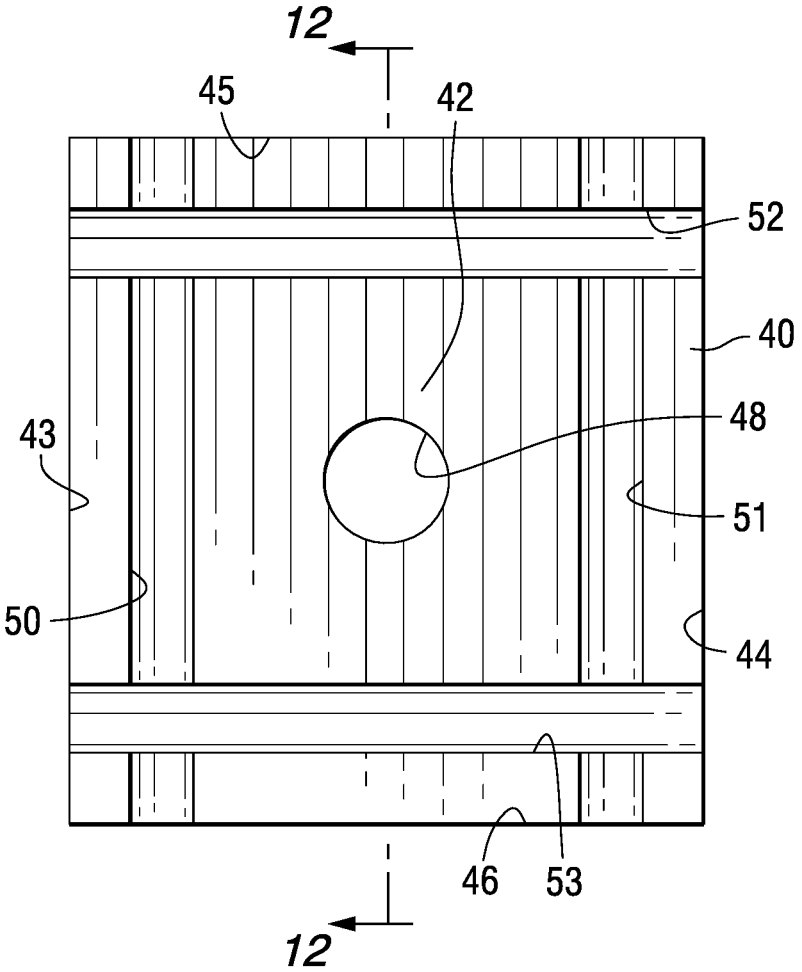
FIG. 11 is a front view of the front plate of the adjustment mechanism in accordance with an embodiment of the present invention.

In accordance with an embodiment of the present invention, the front plate 40 includes first and second vertical support rod receiving guide channels 50 and 51 recessed in a direction perpendicular to the planar surface of the front plate 40, as shown most clearly in FIGS. 11 and 13. Each of the vertical guide channels 50 and 51 has a vertical support rod slidably disposed therein, as shown in FIGS. 9 and 10. The front plate 40 also includes first and second horizontal rod receiving guide channels 52 and 53 recessed in a direction perpendicular to the planar surface of the front plate 40, as shown most clearly in FIGS. 11 and 12. Each of the horizontal guide channels 52 and 53 has a horizontal basket rod slidably disposed therein, as shown in FIGS. 9 and 10. For example, the first horizontal guide channel 52 may slidably receive the upper horizontal basket support rod 22 and the second horizontal guide channel 53 may slidably receive the lower horizontal basket support rod 24. In the embodiment shown, the front plate 40 comprises two horizontal guide channels, but any other suitable number of horizontal guide channels may be used, e.g., zero, one, three or more.

As shown in FIGS. 6-10, 12 and 13, the vertical guide channels 50 and 51 of the front plate 40 form vertical raised regions 54 and 55 on the front surface of the front plate 40. The horizontal guide channels 52 and 53 of the front panel 40 form horizontal raised regions 56 and 57 on the front surface. The vertical raised regions 54 and 55 and horizontal raised regions 56 and 57 thus extend forward from the planar front plate 40. In accordance with an embodiment of the present invention, the planar central region 42 is located in an interior region between the vertical raised regions 54 and 55 and horizontal raised regions 56 and 57.

As shown in FIGS. 3, 7 and 14-17, the back plate 60 includes a planar central region 62, left edge 63, right edge 64, top edge 65, bottom edge 66, and threaded stud 68. The threaded stud 68 may extend from the center of the planar central region 62 of the back plate, and is substantially aligned with the center opening 48 of the front plate 40. In accordance with an embodiment of the present invention, the internally threaded adjustment knob 32 is threadingly engaged with the threaded stud 68. In the embodiment shown, a generally square back plate 60 having four straight edges is shown. However, any other suitable shape of back plate may be used, e.g., rectangular, circular, ovular, triangular, a shape having two straight edges and two curved edges, or the like.

Figure 16:
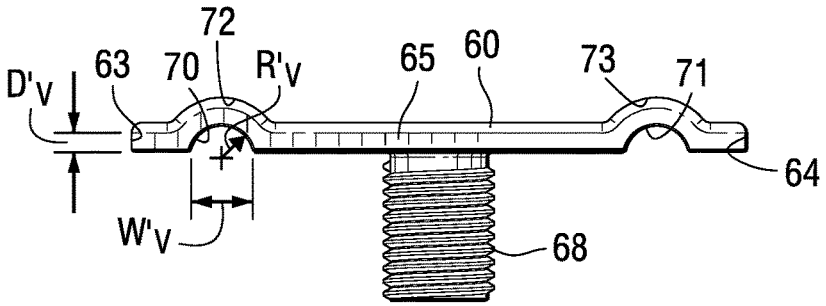
FIG. 16 is a top view of the back plate of FIG. 14.
Figure 14:
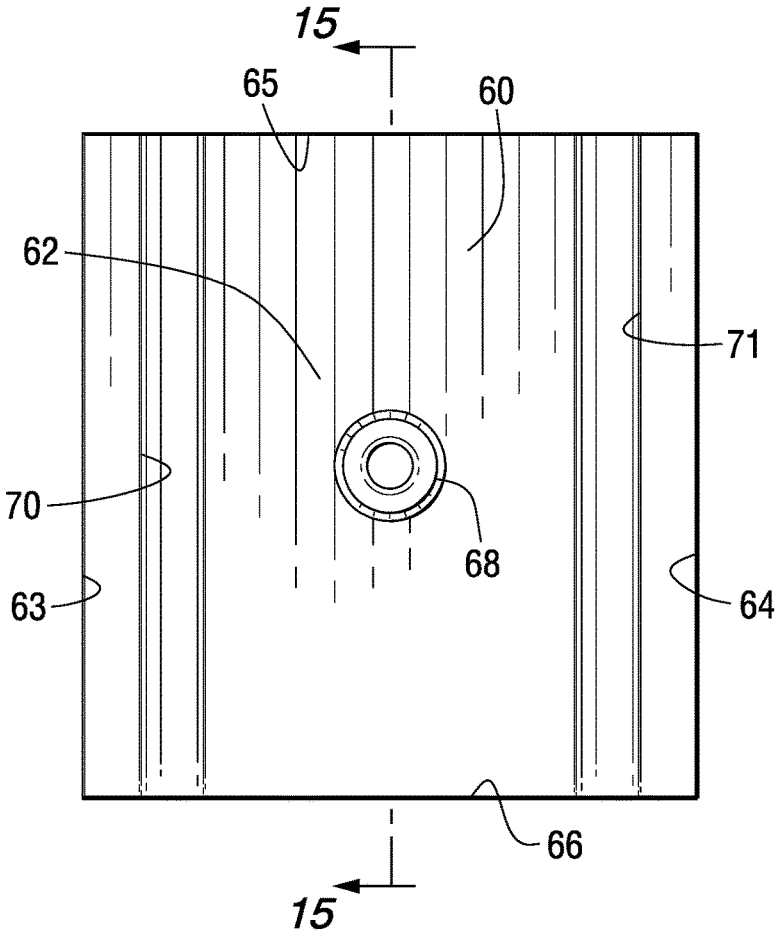
FIG. 14 is a front view of the back plate of the adjustment mechanism in accordance with an embodiment of the present invention.
Figure 15:
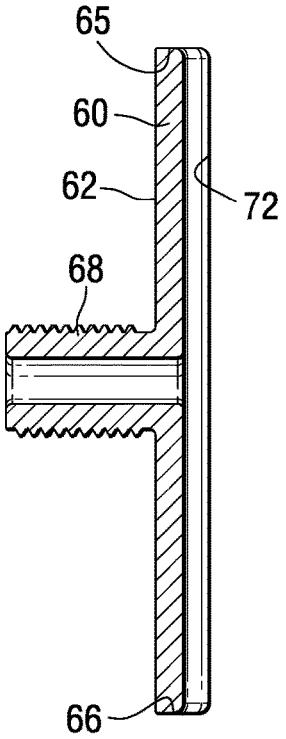
FIG. 15 is a sectional view of the back plate taken through line 16-16 of FIG. 15.
Figure 17:
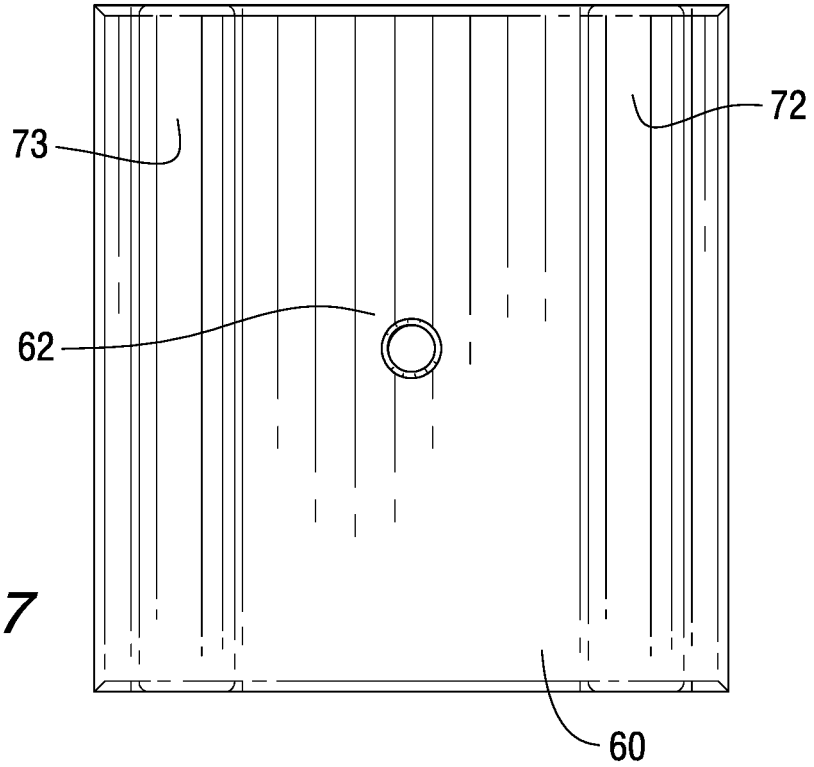
FIG. 17 is a back view of the back plate of FIG. 14.

In accordance with an embodiment of the present invention, the back plate 60 includes first and second vertical support rod receiving guide channels 70 and 71 recessed in a direction perpendicular to the planar surface of the back plate 60, as shown most clearly in FIGS. 14 and 16. Each of the vertical guide channels 70 and 71 has a vertical support rod slidably disposed therein, as shown in FIGS. 9 and 10.

As shown in FIGS. 6-10 and 15-17, the vertical guide channels 70 and 71 form vertical raised regions 72 and 73 on the back surface of the back plate 60. The vertical raised regions 72 and 73 thus extend backward from the planar back plate 60. In accordance with an embodiment of the present invention, the planar central region 62 is located in an interior region between the vertical raised regions 72 and 73.

The vertical support structure 10 and baskets 20 may be made of any suitable materials, including corrosion resistant metals such as aluminum and/or stainless steel, plastic or the like. Any suitable gauge of wire may be used for the rods of the vertical support structure 10 and baskets 20. In accordance with an embodiment of the present invention, the first and second vertical support rods 12 and 14 and the upper and lower horizontal basket support rods 22 and 24 may have a circular cross-section having a diameter. For example, the diameter of the first and second vertical support rods 12 and 14 and the upper and lower horizontal basket support rods 22 and 24 may range from 0.05 to 0.6 inch, or from 0.1 to 0.5 inch or from 0.15 to 0.4 inch. However, any other suitable shape and size of first and second vertical support rods 12 and 14 and upper and lower horizontal basket support rods 22 and 24 may be used, e.g., square, rectangular, ovular, hexagonal or the like. Although the first and second vertical support rods 12 and 14 and the upper and lower horizontal basket support rods 22 and 24 shown in FIGS. 1-5 have similar diameters, it is to be understood that any other suitable sizes may be used, e.g., the first and second vertical support rods 12 and 14 may have different diameters compared with upper and lower horizontal basket support rods 22 and 24, the upper and lower horizontal basket support rods 22 and 24 may have different diameters, etc.

As shown in FIGS. 9 and 10, when the draw fastener 32 is tightened to draw the front plate 40 toward the back plate 60, the horizontal basket support rods 22 and 24 are brought into contact with vertical support rods 12 and 14 forming contact points C. In the embodiment shown, the contact points C may be formed at four separate points of the adjustment mechanism 30, however, any other suitable number contact points C may be formed, e.g., zero, one, two, three or more. The contact points C between the horizontal basket support rods 22 and 24 and the vertical support rods 12 and 14 provide direct engagements between the rods which help secure the adjustment mechanism 30 against vertical movements from their selected vertical position with respect to the vertical support rods 12 and 14 even when the baskets 20 are heavily loaded. The contact points C also help secure each basket 20 against horizontal movement. For example, tightening of the draw fastener 32 causes the vertical guide channels 50 and 51 of the front plate 40 to press against the vertical support rods 12 and 14 and forces them toward the back plate 60. This arrangement also forces the vertical support rods 12 and 14 to press into the vertical guide channels 70 and 71 of the back plate 60. Once the vertical support rods 12 and 14 are pressed into the vertical guide channels 70 and 71 of the back plate 60, additional tightening of the draw fastener 32 may form or increase the pressure at the contact points C between the horizontal basket support rods 22 and 24 and the vertical support rods 12 and 14. In the embodiment shown, the contact points C result in each vertical support rod directly contacting each horizontal basket support rod. This allows the horizontal basket support rods 22 and 24 and vertical support rods 12 and 14 to be engaged at four contact points C.

In accordance with an embodiment of the present invention, the draw fastener 32 exerts a central draw force on the planar central region 42 of the front plate 40 and the planar central region 62 of the back plate 60. The draw force on the front surface of the planar central region 42 of the front plate 40 presses the planar central region 42 toward the planar central region 62 of the back plate. The draw force may also deflect the planar central region 62 and the planar central region 42 toward each other due to the slightly flexible nature of the front and back plates 40 and 60. As shown in FIGS. 8-10, the draw force is applied by the draw fastener 32 in a central region between the four contact points C, which are equally spaced from the centrally applied draw force. This equal spacing results in a substantially equal amount of force being applied to each contact point C. In accordance with an embodiment of the present invention, the resilient nature of the front plate 40 and back plate 60 may help to provide the substantially equal amount of force to each contact point C. Although, the draw fastener 32 of the adjustment mechanism 30 shown in FIGS. 8-10 provides a draw force in a central region between the four contact points C, it is to be understood that the draw force may be provided at any other suitable location, e.g., at a location that is not equally spaced from the contact points C.

Figure 12:
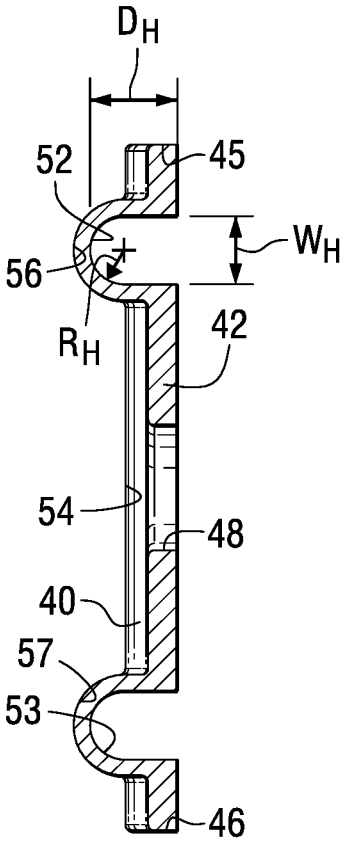
FIG. 12 is a side sectional view of the front plate taken through line 12-12 of FIG. 11.

As shown in FIG. 12, the horizontal guide channels 52 and 53 have a depth $D_H$ and a width $W_H$ selected to allow the horizontal basket support rods 22 and 24 to be totally contained in the horizontal guide channels 52 and 53. For example, the depth $D_H$ of the horizontal guide channels 52 and 53 measured in a direction perpendicular to a planar surface of the front plate 40 may range from 0.1 to 0.8 inch, or from 0.15 to 0.6 inch or from 0.2 to 0.5 inch. In certain embodiments, the depth $D_H$ of the horizontal guide channels 52 and 53 is greater than the diameter of the horizontal basket support rods 22 and 24. For example, the depth $D_H$ of the first and second horizontal guide channels may be from 5 to 100 percent greater, for example, from 10 to 80 percent greater, or from 15 to 50 percent greater than the diameter of the horizontal basket support rods 22 and 24. In certain embodiments, the width $W_H$ of the horizontal guide channels 52 and 53 may typically range from 0.05 to 0.7 inch, for example, from 0.1 to 0.6 inch, or from 0.15 to 0.5 inch. The width $W_H$ may be equal to or slightly greater than the diameter of the horizontal basket support rods 22 and 24.

As shown in FIG. 12, the horizontal guide channels 52 and 53 have a radius $R_H$ that is selected to allow the horizontal basket support rods 22 and 24 to be totally inserted and contained in the horizontal guide channels 52 and 53. For example, the radius $R_H$ of the horizontal guide channels 52 and 53 may range from 0.025 to 0.4 inch, or from 0.05 to 0.3 inch or from 0.1 to 0.25 inch. In accordance with an embodiment of the present invention, the depth $D_H$, width $W_H$ and radius $R_H$ of the horizontal guide channels 52 and 53 may be varied depending on the diameter, size and shape of the horizontal basket support rods 22 and 24. As shown in FIG. 12, the upper and lower horizontal guide channels 52 and 53 may have identical depths $D_H$, widths $W_H$ and/or radiuses $R_H$, or they may be different.

As shown in FIG. 13, the vertical guide channels 50 and 51 of the front plate 40 have a depth $D_V$ and a width $W_V$ selected to allow the vertical support rods 12 and 14 to be partially contained in the vertical guide channels 50 and 51. For example, the depth $D_V$ of the vertical guide channels 50 and 51 measured in a direction perpendicular to a planar surface of the front plate 40 may range from 0.01 to 0.5 inch, or from 0.03 to 0.3 inch or from 0.05 to 0.2 inch. In certain embodiments, the width $W_V$ of the vertical guide channels 50 and 51 may typically range from 0.05 to 0.6 inch, or from 0.1 to 0.5 inch or from 0.15 to 0.4 inch.

As shown in FIG. 13, ends of the vertical guide channels 50 and 51 of the front plate 40 have a radius $R_V$ that is also selected to accommodate and receive the vertical support rods 12 and 14. For example, the radius $R_V$ of the vertical guide channels 50 and 51 may range from 0.025 to 0.4 inch, or from 0.05 to 0.3 inch or from 0.1 to 0.25 inch. In accordance with an embodiment of the present invention, the depth $D_V$, width $W_V$ and radius $R_V$ of the vertical guide channels 50 and 51 may be varied depending on the diameter, size and shape of the vertical support rods 12 and 14. As shown in FIG. 13, the first and second vertical guide channels 50 and 51 of the front plate 40 may have identical depths $D_V$, widths $W_V$ and/or radiuses $R_V$, or they may be different.

As shown in FIG. 16, the vertical guide channels 70 and 71 of the back plate 60 have a depth $D'_V$ and a width $W'_V$ selected to allow the vertical support rods 12 and 14 to be partially contained in the vertical guide channels 70 and 71. For example, the depth $D'_V$ of the vertical guide channels 70 and 71 measured in a direction perpendicular to a planar surface of the back plate 60 may range from 0.01 to 0.5 inch, or from 0.03 to 0.3 inch or from 0.05 to 0.2. In certain embodiments, the width $W'_V$ of the vertical guide channels 70 and 71 may range from 0.05 to 0.6 inch, or from 0.1 to 0.5 inch or from 0.15 to 0.4 inch.

As shown in FIG. 16, the ends of vertical guide channels 70 and 71 have a radius $R'_V$ that is also selected to accommodate and receive the vertical support rods 12 and 14. For example, the radius $R'_V$ of the vertical guide channels 70 and 71 may range from 0.025 to 0.4 inch, or from 0.05 to 0.3 inch or from 0.1 to 0.25 inch. In accordance with an embodiment of the present invention, the depth $D'_V$, width $W'_V$ and radius $R'_V$ of the vertical guide channels 70 and 71 may be varied depending on the size of the vertical support rods 12 and 14. As shown in FIG. 16, the first and second vertical guide channels 70 and 71 of the back plate 60 may have identical depths $D'_V$, widths $W'_V$ and/or radiuses $R'_V$, or they may be different.

In accordance with an embodiment of the present invention, the first and second vertical guide channels 50 and 51 of the front plate 40 and the first and second vertical guide channels 70 and 71 of the back plate 60 form first and second opposing vertical guide channels when the adjustment mechanism 30 is assembled, as shown most clearly in FIGS. 6, 9 and 10. The first and second vertical guide channels 50 and 51 of the front plate 40 and the first and second vertical guide channels 70 and 71 of the back plate 60 may have corresponding depths and/or widths. For example, the depth $D_V$ of the vertical guide channels 50 and 51 of the front plate 40 may be equal to the depth $D'_V$ of the vertical guide channels 70 and 71 of the back plate 60.

In accordance with an embodiment of the present invention, the depths $D_H$ of horizontal guide channels 52 and 53, and the depths $D_V$ of the first and second vertical guide channels 50 and 51, of the front plate 40 are selected to provide the contact points C, as shown in FIGS. 9 and 10. When the adjustment mechanism 30 is tightened, the depth $D_H$ of the horizontal guide channels 52 and 53 and the depths $D_V$ and $D'_V$ of the opposing vertical guide channels 50, 70 and 51, 71, are selected to allow the vertical support rods 12 and 14 and horizontal basket support rods 22 and 24 to contact each other. As shown in FIGS. 9 and 10, when the draw fastener 32 is tightened on the threaded stud 68 to cause the contact points C between the vertical support rods 12 and 14 and the horizontal basket support rods 22 and 24, there may be a gap between the front plate 40 and the back plate 60. Alternatively, the contact points C may still be formed if the front plate 40 and the back plate 60 are brought into contact by the tightening of the adjustment mechanism 30.

In the embodiment shown, the front plate 40 includes two vertical guide channels 50 and 51 and two horizontal guide channels 52 and 53. However, it is it be understood that the front plate 40 may only include horizontal guide channels 52 and 53, in which case, only the back plate 60 may include vertical guide channels 50 and 51. In this alternative embodiment, the depth $D'_V$ of the vertical guide channels 70 and 71 may be altered to accommodate a greater portion of the diameter of the vertical support rods 12 and 14. For example, the depth $D'_V$ and width $W'_V$ of the vertical guide channels 70 and 71 may be similar to the depth $D_H$ and/or width $W_H$ of the horizontal guide channels 52 and 53, as previously described herein. In accordance with another embodiment, the front plate 40 may only include vertical guide channels, and the back plate 60 may only include both horizontal and vertical guide channels.

Figure 18:
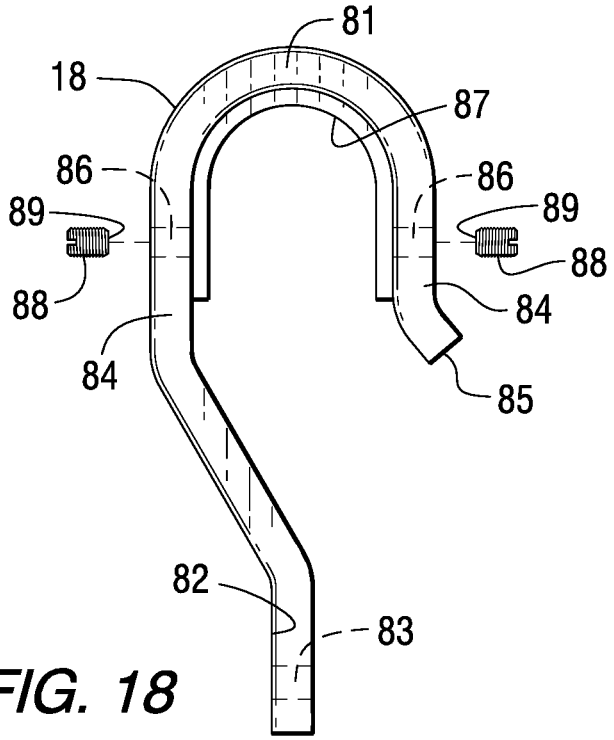
FIG. 18 is a front view of a tilt-resisting support hook in accordance with an embodiment of the present invention.

As shown in detail in FIG. 18, the tilt-resisting support hook 18 comprises an upper pipe engaging portion 81 and a lower portion 82 connected to the vertical support structure 10. In the embodiment shown, the upper pipe engaging portion 81 is generally "U"-shaped and comprises two downwardly extending side legs 84. However, any other suitable shape of upper pipe engaging portion may be used. In the embodiment shown in FIG. 18, one downwardly extending side leg 84 forms an open end 85, while the other downwardly extending side leg 84 is connected to the vertical support structure 10. The open end 85 of the upper pipe engaging portion 81 allows the tilt-resisting support hook 18 to be easily installed on shower pipes having various sizes of shower heads. While the tilt-resisting support hook 18 shown in FIG. 18 has an open end 85, in other embodiments the downwardly extending side legs 84 may form a closed loop at the lower portion 82 and/or to the vertical support structure 10. For example, the downwardly extending side legs 84 of the generally U-shaped upper pipe engaging portion 81 may extend downwardly to couple with the vertical support rods 12 and 14 (not shown). In this embodiment, the downwardly extending side legs 84 may be connected to the vertical support rods 12 and 14 by any suitable attachment means, such as, mechanical fasteners or welding, or may be integrally formed therewith.

Figure 3:
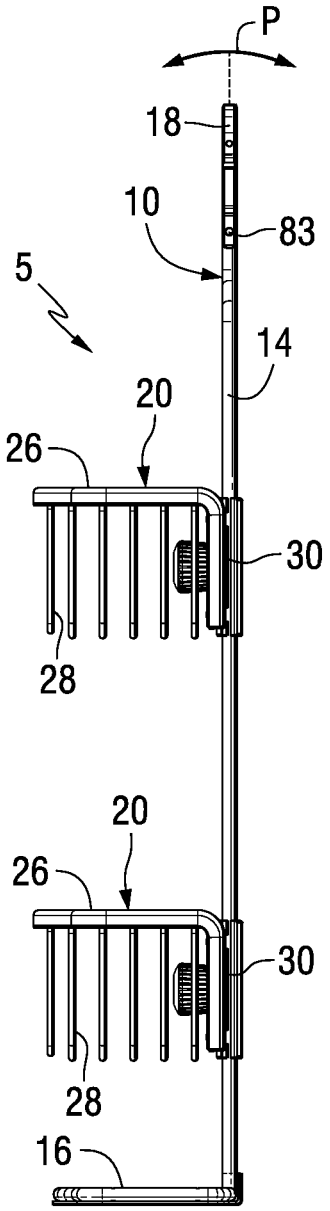
FIG. 3 is a side view of the shower caddy of FIG. 1.

The lower portion 82 may include a support structure connection hole 83. In accordance with an embodiment of the present invention, the vertical support structure 10 may be pivotably attached to the tilt-resisting support hook 18 by inserting a mechanical fastener through the support structure connection hole 83. This arrangement allows the shower caddy assembly 5 to hang vertically when mounted on shower pipes that may be oriented at different angles or when mounted at a location along the pipe that is offset from the back wall of a shower or bath enclosure against which the caddy rests. As shown in FIG. 3, the support hook 18 may be pivotable P around an axis of rotation corresponding to a longitudinal axis of the mechanical fastener in the support structure connection hole 83. Alternatively, the tilt-resisting support hook 18 and the vertical support structure 10 may be fixed in relation to each other or integrally formed. The tilt-resisting support hook 18 may be made of any suitable materials, including corrosion resistant metals such as aluminum and/or stainless steel, plastic or the like.

In accordance with an embodiment of the present invention, the generally U-shaped upper pipe engaging portion 81 may include a resilient liner 87 positioned along at least a portion of an interior surface of the upper pipe engaging portion. In accordance with an embodiment of the present invention, the resilient liner 87 may be made of natural rubber, synthetic rubber, soft polymer, or the like. The resilient liner 87 may be affixed to the interior surface of the generally U-shaped upper pipe engaging portion 81 by any suitable means such as an adhesive.

In accordance with an embodiment of the present invention, the generally U-shaped upper pipe engaging portion 81 comprises at least one threaded fastener hole 86 receiving a threaded fastener 88. As shown in FIG. 18, each downwardly extending side leg 84 may include a threaded fastener hole 86. In the embodiment shown, there are two threaded fastener holes 86 and associated fasteners 88, but any other suitable number of threaded fastener holes may be used. For example, there may be zero, one, three, four or more threaded fasteners. Each threaded fastener 88 extends from the exterior side surface to an interior side surface of the downwardly extending side leg 84 to press against the shower pipe. In the embodiment shown, a threaded fastener 88 is inserted into each threaded fastener hole 86 and tightened in order to secure the tilt-resisting support hook 18 and shower caddy assembly 5 in place.

The threaded fasteners 88 may be threaded and may comprise an Allen screw, thumb screw, flat head screw, Phillips head screw, or the like. The end 89 of each threaded fastener 88 may contact the resilient liner 87 to press against the shower pipe when tightened without direct contact between the threaded fasteners 88 and the shower pipe. The resilient liner 87 is forced against the shower pipe by the threaded fastener 88 to reduce or eliminate unwanted movement of the tilt-resisting support hook 18 and the shower caddy assembly 5. In the embodiment shown, the tilt-resisting support hook 18 comprising the resilient liner 87 and the threaded fastener holes 86 and associated fasteners 88 provide a tilt-resisting locking mechanism. In accordance with another embodiment of the present invention, the tilt-resisting support hook 18 may not include a resilient liner 87 and may instead include threaded fasteners 88 having resilient material positioned at their ends. For example, the threaded fasteners 88 may be an Allen type screw having a rubber tip on their ends that can be tightened directly against the shower pipe.

While a tilt-resisting support hook 18 is described herein, any other suitable tilt-resisting or non-tilt resisting support structure capable of supporting the caddy assembly 5 on a shower pipe may be used. Alternative tilt-resisting supports may include various types of clamps, clips and fasteners, such as disclosed in U.S. Patent Application Publication No. US2014/0224754 A1 published Aug. 14, 2014, which is incorporated herein by reference.

Whereas particular embodiments of this invention have been described above for purposes of illustration, it will be evident to those skilled in the art that numerous variations of the details of the present invention may be made without departing from the invention as defined in the appended claims.

What is claimed is:

1. A shower caddy assembly comprising:

a vertical support structure comprising a first and a second vertical support rod;

at least one basket coupled to the vertical support structure; and an adjustment mechanism comprising:

a front plate having a left rear facing surface extending inwardly from an outermost left side edge, a right rear facing surface extending inwardly from an outermost right side edge, and a planar central surface parallel with the first and second vertical support rods, and first and second vertical guide channels, wherein the first vertical guide channel is between the left rear facing surface and the planar central surface, and the second vertical guide channel is between the right rear facing surface and the planar central surface;

a rear plate having a left front facing surface extending inwardly from an outermost left side edge, a right front facing surface extending inwardly from an outermost right side edge, a planar central surface parallel with the first and second vertical support rods, and first and second vertical guide channels, wherein the first vertical guide channel is between the left front facing surface and the planar central surface, and the second vertical guide channel is between the right front facing surface and the planar central surface;

and a draw fastener, wherein the left and right rear facing surfaces of the front plate are spaced from the left and right front facing surfaces of the rear plate when the first and second support rods are clamped between the front and rear plates to thereby restrict relative vertical movement between the adjustment mechanism and the first and second vertical support rods.

2. The shower caddy assembly of claim 1, wherein the planar central surface of the front plate is spaced from the planar central surface of the rear plate when the first and second support rods are clamped between the front and rear plates.

3. The shower caddy assembly of claim 1, wherein the first and second vertical support rods are generally parallel to each other and spaced apart to define an opening there between.

4. The shower caddy assembly of claim 1, wherein the draw fastener is threadingly engaged with the rear plate.

5. The shower caddy assembly of claim 1, wherein the at least one basket comprises at least one horizontal basket support rod and when the first and second vertical support rods are clamped between the front and rear plates, the at least one horizontal basket support rod is brought into contact with the first and second vertical support rods forming at least one contact point C, and wherein the at least one contact point C prevents the left and right rear facing surfaces of the front plate from contacting the left and right front facing surfaces of the rear plate.

6. The shower caddy assembly of claim 1, wherein the at least one basket comprises an upper horizontal basket support rod and a lower horizontal basket support rod and when the first and second vertical support rods are clamped between the front and rear plates, the upper and lower horizontal basket support rods are brought into contact with the first and second vertical support rods forming four contact points.

7. The shower caddy assembly of claim 6, wherein the four contact points are equally spaced from the draw fastener.

8. The shower caddy assembly of claim 1, wherein the first and second vertical guide channels of the rear plate slidably receive the first and second vertical support rods.

9. The shower caddy assembly of claim 1, wherein a radius $R_V$ of the first and second vertical guide channels of the front plate is larger than a depth $D_V$ of the first and second vertical guide channels of the front plate, and a radius $R_V$ of the first and second vertical guide channels of the rear plate is larger than a depth $D_V$ of the first and second vertical guide channels of the rear plate.

10. The shower caddy assembly of claim 1, wherein the front plate comprises at least one horizontal guide channel slidably receiving at least one horizontal basket support rod.

11. The shower caddy assembly of claim 1, wherein the at least one basket comprises an upper horizontal basket support rod and a lower horizontal basket support rod.

12. The shower caddy assembly of claim 11, wherein the front plate comprises a first horizontal guide channel slidably receiving the upper horizontal basket support rod, and a second horizontal guide channel slidably receiving the lower horizontal basket support rod.

13. The shower caddy assembly of claim 11, wherein the front plate comprises a first horizontal guide channel slidably receiving the upper horizontal basket support rod and a second horizontal guide channel slidably receiving the lower horizontal basket support rod.

14. The shower caddy assembly of claim 13, wherein the first and second horizontal guide channels have a depth Du measured in a direction perpendicular to a planar surface of the front plate of from 0.1 to 0.8 inch.

15. The shower caddy assembly of claim 14, wherein the depth $D_H$ of the first and second horizontal guide channels is from 80 to 180 percent of a diameter of the upper and lower horizontal basket support rods.

16. The shower caddy assembly of claim 1, wherein the first and second vertical guide channels of the front plate have a depth $D_V$ measured in a direction perpendicular to a planar surface of the front plate of from 0.01 to 0.5 inch and the first and second vertical guide channels of the rear plate have a depth $D'_V$ measured in a direction perpendicular to a planar surface of the rear plate of from 0.01 to 0.5 inch.

17. The shower caddy assembly of claim 6, wherein the first and second vertical support rods and the upper and lower horizontal basket support rods are clamped between the front and rear plates when the draw fastener is tightened.

18. The shower caddy assembly of claim 1, wherein the draw fastener comprises an internally threaded knob threadingly engaged with a threaded stud extending from the rear plate.

19. The shower caddy assembly of claim 1, comprising at least two of the baskets.

20. The shower caddy assembly of claim 1, further comprising a tilt-resisting support hook comprising an upper pipe engaging portion and a lower portion coupled to the vertical support structure.

* * * * *